US008695457B2

(12) United States Patent
Rozmus et al.

(10) Patent No.: US 8,695,457 B2
(45) Date of Patent: Apr. 15, 2014

(54) POP-TOP CAN OPENER

(76) Inventors: Michael J. Rozmus, Chicago, IL (US); Bruce D. Kielbasa, Algonquin, IL (US)

( * ) Notice: Subject to any disclaimer, the term of this patent is extended or adjusted under 35 U.S.C. 154(b) by 293 days.

(21) Appl. No.: 13/106,678

(22) Filed: May 12, 2011

(65) Prior Publication Data

US 2012/0285297 A1 Nov. 15, 2012

(51) Int. Cl.

| | |
|---|---|
| ***B67B 7/40*** | (2006.01) |
| ***B67B 7/44*** | (2006.01) |
| ***B67B 7/50*** | (2006.01) |

(52) U.S. Cl.

USPC ..... 81/3.57; 30/450; 81/3.09; 81/3.55

(58) Field of Classification Search

USPC ..... 81/3.57, 3.09, 3.55, 3.47; 30/414, 30/443–445, 449, 450; 7/152, 156

See application file for complete search history.

(56) References Cited

U.S. PATENT DOCUMENTS

| | | | | |
|---|---|---|---|---|
| D171,415 | S * | 2/1954 | Lipman | 30/450 |
| 2,761,210 | A * | 9/1956 | Chun | 30/446 |
| 3,269,586 | A | 8/1966 | Quimby et al. | |
| 3,460,411 | A * | 8/1969 | Dyer | 81/3.07 |
| 3,656,375 | A | 4/1972 | Reed et al. | |
| 3,724,297 | A | 4/1973 | Bucko | |
| 4,120,216 | A | 10/1978 | Goldberg | |
| 4,133,228 | A | 1/1979 | DePooter | |
| 4,136,448 | A | 1/1979 | Fournier et al. | |
| 4,253,352 | A | 3/1981 | O'Neal | |
| 4,373,223 | A | 2/1983 | Miller | |
| 4,524,646 | A | 6/1985 | Kimberlin, Jr. | |
| 4,583,429 | A | 4/1986 | Kroeger et al. | |
| 4,617,842 | A | 10/1986 | Yang | |
| 4,864,898 | A | 9/1989 | Tricinella | |
| 6,311,580 | B1 * | 11/2001 | Nagy | 81/3.55 |
| D538,117 | S * | 3/2007 | Lin | D8/18 |
| 7,827,884 | B2 * | 11/2010 | Lawson | 81/3.09 |
| 2005/0076742 | A1 * | 4/2005 | Yurek et al. | 81/3.55 |

OTHER PUBLICATIONS

NoJoke.com, The Shotgun, Webpage, Jul. 2, 2010.

* cited by examiner

*Primary Examiner* — Hadi Shakeri

(74) *Attorney, Agent, or Firm* — Edwards Wildman Palmer LLP

(57) ABSTRACT

A can opener is adapted for engaging and lifting a tab attached to the flat upper surface (top) of a sealed can, with the upraised tab engaging and downwardly displacing a sealing member for opening the can. The opener includes a handle with first and second arms extending therefrom. The curvilinear first arm is adapted for positioning between the can's upper surface and the tab and for raising the tab when the handle is pivotally moved outwardly from the can's upper edge which acts as a fulcrum in engaging a lower portion of the curvilinear first arm. A second arm extending from the handle and disposed in closely spaced relation from the first arm includes a pointed end portion adapted to engage and puncture an upper lateral portion of the can to prevent formation of an air lock in the can for facilitating the discharge of the liquid contents of the can.

13 Claims, 2 Drawing Sheets

POP-TOP CAN OPENER

FIELD OF THE INVENTION

The present invention relates generally to can openers, and is particularly directed to an opener for a pop-top beverage can which opens a can in a manner which allows for more quickly emptying the can of its liquid contents.

BACKGROUND OF THE INVENTION

Early pop-top, or tab-type, cans contained a ring member attached to a sealing member disposed over an opening in the top of a can containing a liquid. The can was opened by removing the combination of the ring member and sealing member. Primarily for environmental reasons, this combination was replaced with a generally elongated tab which is manually engaged and pivotally displaced about a rivet attaching the tab to the top of the can. The pivoting tab engages a sealing member and pivotally urges the sealing member into the can in opening the can. The tab and sealing member remain attached to the top of the can. The flat top of the can is provided with a weakened score line having a generally oval shape which is adapted to be broken from the can top and forced downwardly into the can by the upraised tab. This action forms a generally oval-shaped opening in the top of the can from which its liquid contents may be dispensed.

Opening a sealed can in this manner requires a certain amount of dexterity and strength generally not possessed by children and others having diseased or injured hands or long fingernails which the person does not want to damage or disfigure. To address these situations, various manual pop-top can openers have been proposed. The following list of patents is directed to can openers of this type:

U.S. Pat. No. 3,656,375
U.S. Pat. No. 3,724,297
U.S. Pat. No. 4,120,216
U.S. Pat. No. 4,133,228
U.S. Pat. No. 4,253,352
U.S. Pat. No. 4,373,223
U.S. Pat. No. 4,524,646
U.S. Pat. No. 4,583,429
U.S. Pat. No. 4,617,842
U.S. Pat. No. 4,864,898

All of the above-listed can openers are designed to open a sealed aperture in the top of the can. However, none of these openers provides for normal flow of the liquid contents from the can because of the presence of an air lock formed within the can when it is inverted to pour out its contents. The air lock results in a reduced, irregular discharge of the liquid contents from the can. The present invention prevents the formation of an air lock in the opening of a sealed can for facilitating discharge of the liquid contents in a uniform, maximum flow rate from the can.

OBJECTS AND SUMMARY OF THE INVENTION

Accordingly, it is an object of the present invention to provide an opener for a pop-top, or tab-type, can which permits the can to be emptied more quickly.

It is another object of the present invention to open a sealed pop-top can in a manner which prevents the formation of an air lock, or a vacuum, within the can when opened for allowing for the can to be emptied more quickly.

It is another object of the present invention to open a sealed pop-top can by simultaneously raising the tab to unseat the sealed top portion, while piercing an upper portion of the can's lateral wall to allow the can to be more quickly emptied.

The present invention contemplates an apparatus for opening a pop-top can having a sealing member disposed over an opening in the top of the can and a tab attached to the top of the can, the apparatus comprising a handle; a first arm attached to and extending from the handle and having a distal end portion adapted for positioning between the tab and the top of the can, the first arm further including a proximal portion disposed between the distal end and the handle and adapted to engage the upper end of the can; and a second arm attached to and extending from the handle and disposed below the first arm when the first arm is positioned between the tab and the top of the can, the second arm having a pointed distal end; wherein when the handle is pivotally displaced away from the top of the can, the distal end of the first arm raises the tab which pushes the sealing member into the can in opening the can, and wherein the pointed distal end of the second arm engages and forms an opening in a side wall of the can allowing air to enter the can and the can to be emptied more quickly.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 2:
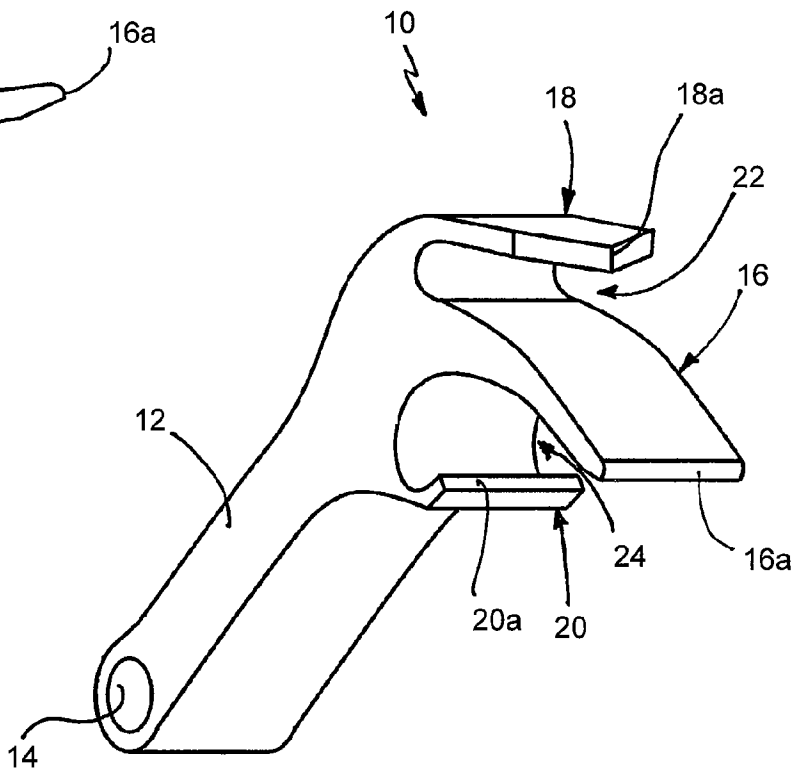
FIG. 2 is a perspective view of the inventive can opener shown in FIG. 1.
Figure 1:
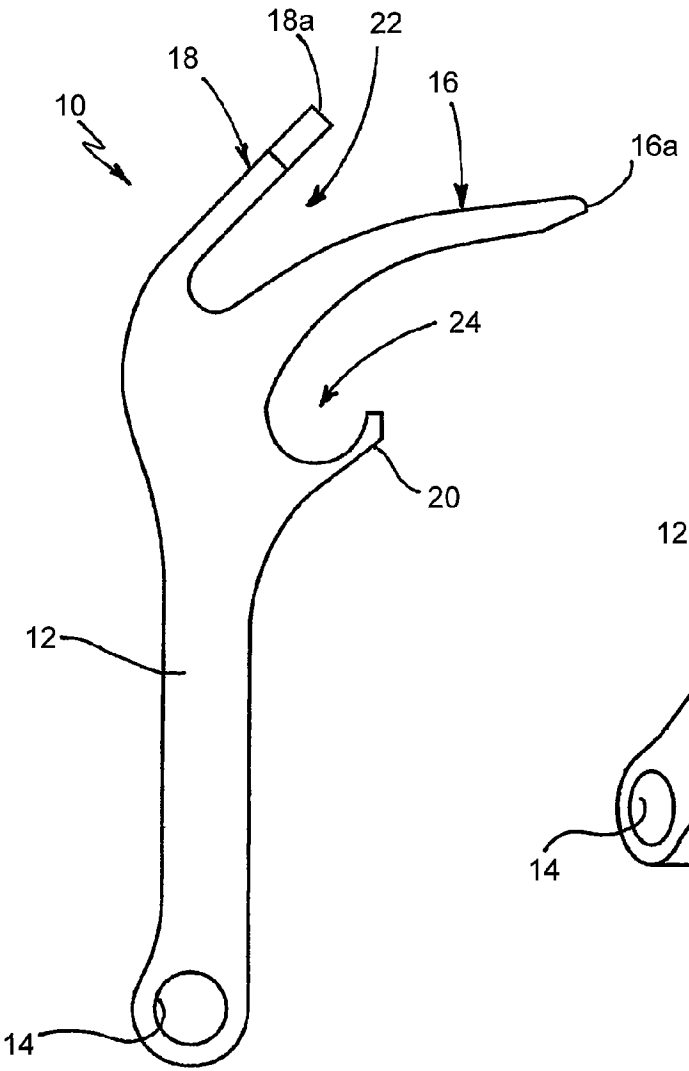
FIG. 1 is a side elevation view of a can opener in accordance with the principles of the present invention.

FIGS. 1 and 2 are respectively side elevation and perspective views of a pop-top can opener 10 in accordance with the principles of the present invention.

Can opener 10 includes an elongated handle 12 having one end with an aperture 14 therein. Aperture 14 is adapted to receive a support member such as a key ring or a line (not shown for simplicity) for supporting the can opener and maintaining it in a convenient location or position for use. Disposed on and extending from a second opposed end portion of handle 12 is a first arm 16. First arm 16 is generally curvilinear in shape and includes a flat distal end 16*a*. Also disposed on the second end of handle 12 is a second arm 18 which is generally linear and includes a pointed distal end 18*a*. A first space, or gap, 22 is disposed between the first and second arms 16, 18. Also disposed on and extending from the enlarged second end of handle 12 is a third arm 20 having a flat distal end 20*a*. A second space, or gap, 24 is disposed between the second and third arms 18, 20. Can opener 10 is preferably in the form of a unitary structure and preferably comprised of a high-strength material such as metal, e.g., steel or an aluminum alloy.

Figure 3:
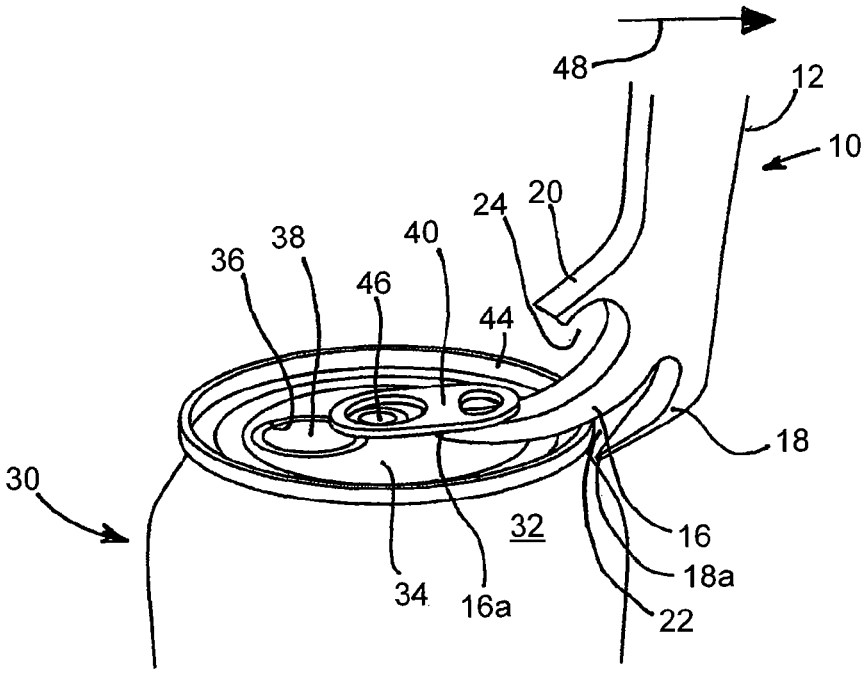
FIG. 3 is a perspective view of an upper portion of a can on which the can opener of the present invention has been positioned prior to opening of the can.
Figure 4:
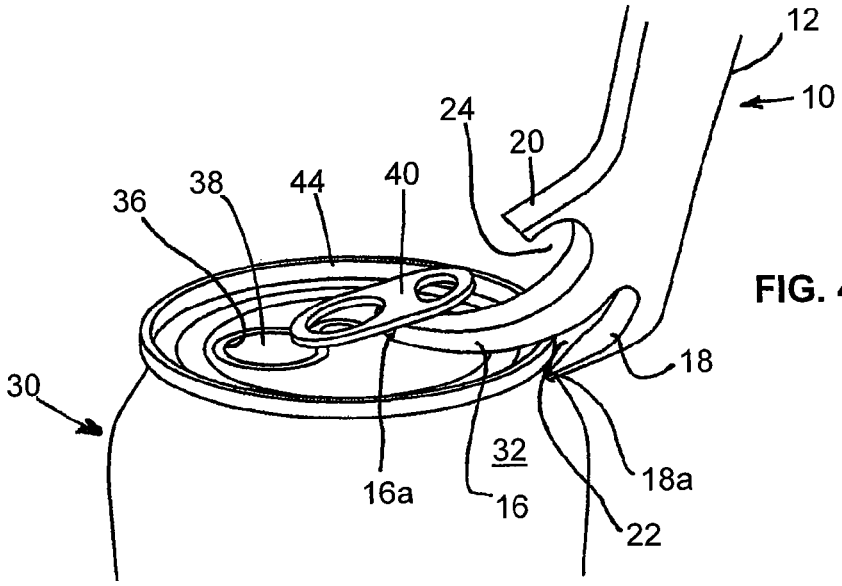
FIG. 4 is an upper perspective view of a can showing the inventive can opener engaging and raising a tab disposed on the top of the can for opening the can and forming an aperture within an upper lateral portion of a can in accordance with the present invention.
Figure 5:
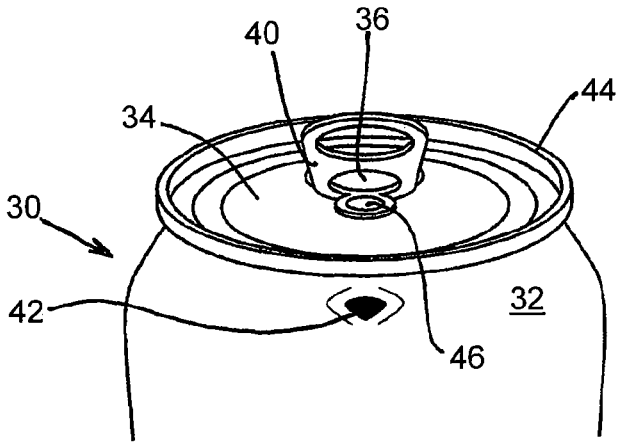
FIG. 5 is an upper perspective view of a can opened using the can opener of the present invention illustrating the location of an aperture formed in the can simultaneously with opening of the can.

Referring to FIG. 3, there is shown a perspective view of an upper end portion of a sealed can 30 on which is positioned the can opener 10 of the present invention. Can 30 includes a generally cylindrical lateral wall 32, and a generally flat bottom (not shown) and generally flat top 34. Disposed about the generally circular, flat top 34 is a peripheral rim, or collar, 44 which extends in an upward direction from the can's top. Attached to the can's top 34 such as by means of a rivet 46 is a ring-like tab 40. Disposed adjacent an end of tab 40 and removably attached to the can's top 34 and disposed over an aperture, or opening, 36 within the can's top in a sealed manner is a seal 38. The first arm 16 of can opener 12 is adapted for positioning between tab 40 and the top 34 of can 30. The distal end 16*a* of first arm 16 is generally flat and the first arm tapers to a reduced thickness if proceeding toward its distal end to facilitate insertion of the first arm 16 between tab 40 and the top 34 of can 30 as shown in FIG. 3.

Once the distal end of first arm 16 is positioned between and in contact with the can's top 34 and its tab 40, the handle 12 of can opener 10 is rotated clockwise in the direction of arrow 48 away from the top of the can 30 as shown in FIG. 3. The lower surface of the first arm 16 is positioned in contact with a portion of the top 34 of can 30, i.e., the can's upper rim 44 which serves as a fulcrum, or support, for the can opener 10 as it is pivotally displaced. As the can opener's handle 12 is displaced in the direction of arrow 48, the flat distal end 16*a* of the can opener's first arm 16 is displaced upwardly so as to raise tab 40 in a pivoting manner about the rivet 46 securing the tab to the can's top 34. As the tab 40 is pivotally displaced upward by the can opener's first arm 16, an end of the tab engages seal 38 disposed in sealed contact with the can's top 34 and displaces the seal in a downward direction so as to uncover the aperture 36 in the can's top 34. Uncovering of opening 42 within the can's top 34 allows the liquid contents of the can to be discharged by inverting the orientation of the can 30 so that its top is directed downwardly.

As the can opener's handle 12 is moved in the direction of arrow 48, the pointed distal end 18*a* of second arm 18 engages and pierces an upper portion of the can's lateral wall 32 so as to form an opening 42 within the lateral wall. This allows air to enter into can 30 and facilitates discharge of the liquid contents of the can at an uninterrupted maximum flow rate. It is in this manner that the opening 42 eliminates the possibility of an air lock forming within can 30 during the discharge of the liquid contents from the can. In the absence of opening 32, an air lock would form within can 30 if it is quickly inverted in forming an evacuated volume within the can which inhibits discharge of the liquid contents of the can through opening 36 when inverted. With an air lock present within can 30, the discharge flow rate of liquid from the can would be irregular and reduced.

The inventive can opener 10 further includes a third arm 20 extending from the enlarged end portion of handle 12. Third arm has a generally flat distal end 20*a*. A second space, or gap, 24 is disposed between first arm 16 and third arm 20. By positioning the flat distal end 16*a* of first arm 16 in contact with the upper surface of a cap disposed in a sealed manner on the upper end of a bottle, the flat distal end 20*a* of third arm 20 may be positioned beneath and in engagement with the outer, peripheral, undulating edge of a bottle cap (not shown). Upward movement of the handle 12 of can opener 10 will result in removal of the cap from the bottle in a conventional manner.

While particular embodiments of the invention have been described, it will be obvious to those skilled in relevant arts that changes and modifications may be made without departing from the invention in its broader aspects. Therefore, the aim in the appended claims is to cover all such changes and modifications that fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. Apparatus for opening a pop-top can having a sealing member disposed over an opening in the top of said can and a tab attached to the top of said can, said apparatus comprising:

a handle;

a first arm attached to and extending from said handle and having a distal end portion adapted for positioning between the tab and the top of said can, said first arm further including a proximal portion disposed between said distal end and said handle and adapted to engage the upper end of said can; and a second arm attached to and extending from said handle and disposed below said first arm when said first arm is positioned between the tab and the top of said can, said second arm having a pointed distal end;

wherein when said handle is pivotally displaced away from the top of said can, the distal end of said first arm raises the tab which pushes the sealing member into the can in opening the can, and wherein the pointed distal end of said second arm engages and forms an opening in a side wall of the can allowing air to enter the can and the can to be emptied more quickly.

2. The apparatus of claim 1, wherein said handle and said first and second arms form a unitary structure.

3. The apparatus of claim 2, wherein said unitary structure is comprised of a metal or a metal alloy.

4. The apparatus of claim 1, where said first arm is curvilinear and extends away from said second arm in proceeding from the proximal portion toward the distal end of said first arm.

5. The apparatus of claim 1, wherein said first arm includes a concave upper portion and a convex lower portion with said first arm disposed between the tab and the top of said can.

6. The apparatus of claim 1, wherein said second arm is disposed on an end portion of and extends from said handle.

7. The apparatus of claim 6, wherein said first and second arms are disposed on and extend from a first end of said handle.

8. The apparatus of claim 1, wherein said handle includes an attachment aperture on a second opposed end of said handle.

9. The apparatus of claim 1 further comprising a third arm in the form of a bottle opener attached to said handle.

10. The apparatus of claim 9, wherein said handle, said first, second and third arms form a unitary structure.

11. The apparatus of claim 10, wherein said unitary structure is comprised of metal or a metal alloy.

12. The apparatus of claim 9, wherein said third arm bottle opener is disposed adjacent said first arm and includes a generally flat distal end portion, and wherein the distal end portion of said first arm is adapted to engage an upper portion of a bottle cap and the flat distal end portion of said third arm is adapted to engage and displace an outer, peripheral edge of a bottle cap when the apparatus is used as a bottle opener.

13. The apparatus of claim 1, wherein the upper end of said can includes an upwardly extending peripheral rim, and wherein said first arm engages said peripheral rim when said handle is pivotally displaced away from the top of said can.

* * * * *